United States Patent [19]

Peter et al.

[11] Patent Number: 4,672,934

[45] **Date of Patent: * Jun. 16, 1987**

[54] METHOD AND APPARATUS FOR ADAPTING THE CHARACTERISTIC OF A FINAL CONTROLLING ELEMENT

[75] Inventors: Cornelius Peter; Claus Ruppmann, both of Stuttgart, Fed. Rep. of Germany

[73] Assignee: Robert Bosch GmbH, Stuttgart, Fed. Rep. of Germany

[ * ] Notice: The portion of the term of this patent subsequent to Feb. 4, 2003 has been disclaimed.

[21] Appl. No.: 725,392

[22] Filed: Apr. 22, 1985

Related U.S. Application Data

[63] Continuation-in-part of Ser. No. 650,812, Sep. 14, 1984, Pat. No. 4,567,869.

[30] Foreign Application Priority Data

Sep. 21, 1983 [DE] Fed. Rep. of Germany ..... 3334062
Apr. 21, 1984 [DE] Fed. Rep. of Germany ..... 3415183

[51] Int. Cl.[4] ..... F02D 41/16
[52] U.S. Cl. ..... 123/339; 123/350
[58] Field of Search ..... 123/339, 340, 350

[56] References Cited

U.S. PATENT DOCUMENTS 4,108,127 8/1978 Chapin et al. ..... 123/339
4,567,869 2/1986 Peter et al. ..... 123/339

FOREIGN PATENT DOCUMENTS 2128779 5/1984 United Kingdom ..... 123/339

*Primary Examiner*—Andrew M. Dolinar
*Attorney, Agent, or Firm*—Walter Ottesen

[57] ABSTRACT

The invention is directed to a method and an apparatus for adapting the characteristic of a final controlling element to eliminate disturbances and other undesired influencing quantities and, particularly for adapting the controller characteristic for the idle air charge control of internal combustion engines. A desired air quantity value issued by a regulator on the basis of various operating conditions is corrected by multiplicative and/or additive action prior to being delivered to an idle control element, for example, by means of which a change is effected in the cross-sectional area of the opening of a bypass valve arranged in the fuel metering arrangement of the internal combustion engine. This correction relates to adapting a characteristic of the idle control element with respect to offset and slope. This is accomplished by evaluating the output signals of at least one offset integrator or one slope integrator to generate an adapted electrical actuating quantity for the idle control element. The integrators are released in dependence on operating conditions and receive an input differential signal obtained from the signal indicative of the desired air quantity value from the regulator and a signal indicative of the actual air quantity.

6 Claims, 3 Drawing Figures

METHOD AND APPARATUS FOR ADAPTING THE CHARACTERISTIC OF A FINAL CONTROLLING ELEMENT

RELATED APPLICATION

This is a continuation-in-part of the application Ser. No. 650,812, filed Sept. 14, 1984 which is now U.S. Pat. No. 4,567,869 entitled "Method and Apparatus for Adapting the Characteristic of a Final Controlling Element".

BACKGROUND OF THE INVENTION

In many fields of engineering, it is conventional practice to determine certain quantities, values or positions by means of closed or open loop control. This is accomplished by utilizing a regulator to deliver a quantity, usually electrical, indicative of a specific function course to some final controlling element; the regulator processes specific input signals from the controlled system and also includes in its control action the result obtained by the adjustment of the final controlling element. If, in the overall configuration of an open or closed loop control, disturbances or other undesired influencing quantities result which are exclusively attributable to the action of the final controlling element, in other words, the characteristic of the final controlling element does not follow exclusively the desired value supplied to it, then substantial deviations from the set values may occur which may give rise to overshoot depending on the time constants occurring, or the control may be too slow.

While being generally suitable for the adaptation of the characteristic of any kind of final controlling element, the invention will be explained in the following with reference to a preferred embodiment, applied to the action of the final controlling element in the idle air charge controller for an internal combustion engine, since this is a preferred field of application for the invention.

Thus, it is known to regulate the idle speed of an internal combustion engine such that an idle speed regulator receives specific data on the instantaneous operating condition of the internal combustion engine including, for example, intake manifold pressure, instantaneous speed, desired idling speed and other peripheral operating data such as throttle position, the position of a bypass valve on which the idle air charge controller especially acts, and/or data on the quantity of intake air or air mass in lieu of the intake manifold pressure.

The idle speed regulator is in a position to determine from these quantities an electrical correcting quantity as a desired value, for example, a signal $\dot{Q}_{des}$ indicative of the desired air quantity or a signal $\dot{m}_{des}$ indicative of the desired air mass and feed this signal to an idle control element which converts, for example, the air mass desired value into a cross-sectional area of aperture (of the bypass valve referred to above).

It is particularly in the idle air charge controller for an internal combustion engine that allowance has to be made for special conditions such as minimum possible fuel consumption and keeping a minimum idle speed constant even on abrupt load changes. Accordingly, idle speed regulators are known from U.S. Pat. No. 4,441,471 and are configured to compensate for deviations from a desired speed and to hold such deviations to a low value. However, a problem to be realized in this connection is that speed variations ultimately reflect reactions of the internal combustion engine to external influences and that corresponding speed signals constitute the last link in the control chain, so that necessarily a certain amcunt of time will elapse between an action on the internal combustion engine and its ensuing reaction thereto. Therefore, in internal combustion engines running at extremely low rpm while idling, there exists at least the danger of an uneven running condition occurring and finally the possibility of a stalled engine if loads with high power requirements such as air conditioners and the like are switched in rapidly.

This problem is even increased by the action of the idle control element itself since the control element characteristic shows a considerable dependency upon the relevant temperature and the operating voltage supplied by the internal combustion engine which likewise may be subject to major variations. Conventionally, idle control elements operate as electromagnetic converters with respect to the adjustment of the cross-sectional area of the aperture through which the internal combustion engine receives the required quantity of air, in which case they may be configured as single-winding controllers or as a magnet part in the actuation of a valve.

With the idle control element cold, the winding of the control element will take up a larger amount of current at a given pulse duty factor; the result is a larger deflection and a corresponding mismatch. Similar negative effects result when the battery voltage varies substantially as is frequently the case in internal combustion engines. Therefore, in order to minimize the mismatch in the control element range, the idle control element requires a complex configuration and a highly consistent characteristic in order to properly convert the electrical actuating quantity supplied to its input into the cross-sectional area of the opening.

However, even with an idle control element reacting as perfectly as possible, unavoidable dependencies remain, such as leakage air flowing past the throttle valve in the idle position, a dependence on altitude of the cross-sectional area of the aperture provided by the idle control element and the like.

SUMMARY OF THE INVENTION

It is, therefore, one of the objects of the invention to provide an apparatus for adapting the characteristic of a final controlling element which satisfies the condition that the desired quantity delivered to the final controlling element is substantially equal to the actual quantity obtained from the action of the final controlling element with the inclusion of marginal influences, applied to the idle control element with respect to an idle control element characteristic, that is, that the desired air quantity or air mass quantity at the output of the idle speed regulator is substantially equal to the air quantity or air mass supplied to, or drawn in by, the internal combustion engine.

The method and apparatus of the invention afford the advantage that the adaptation of the characteristic of the final controlling element (which may vary under certain influencing quantities) as well as the inclusion and consequently also the leveling of other disturbances are performed so as to result in an effective independence of the control element characteristic, thereby obviating the need for an especially complex configuration of the particular final controlling element utilized which, when applied to idle air charge control, is the idle control element. The invention permits the use of a simpler controller configuration, whereby complete independence is obtained of the altitude at which the internal combustion engine is at a given time when the air mass is measured and the dependence on altitude is drastically reduced where air quantity is measured.

Further, the invention ensures an independence of leakage air, thus dispensing with the need for engine adjustments; in addition, the adaptation of the invention which proceeds throughout the entire control operation ensures that the actual idle air charge control is not influenced.

The possibility to reduce the iteration steps and thereby accelerate the adaptation procedure is of particular advantage. This is accomplished in that a slope adaptation is immediately followed by the offset integrator according to a specific computation rule so that the characteristic rotates about the last operating point of an actual air quantity which has been stored in memory at the time the throttle valve was previously opened, and not about a more distant reference value.

Further, adaptation errors which may result from several successive slope adaptations can be avoided because another slope adaptation cannot be released until a successful offset adaptation has taken place subsequent to the preceding slope adaptation. In this arrangement, the offset integrator is always active, that is, released, if the throttle valve is closed, the slope integrator is inactive and a predetermined off-period has elapsed. The slope integrator is suitably released only if the actual air quantity is greater than the air quantity stored at the time the throttle valve was opened, plus a predeterminable air quantity.

Further advantages of the invention will become apparent from the subsequent description of the preferred embodiments of the invention.

BRIEF DESCRIPTION OF THE DRAWING

The invention will now be described with reference to the drawing wherein.

DESCRIPTION OF THE PREFERRED EMBODIMENTS OF THE INVENTION

Figure 1:
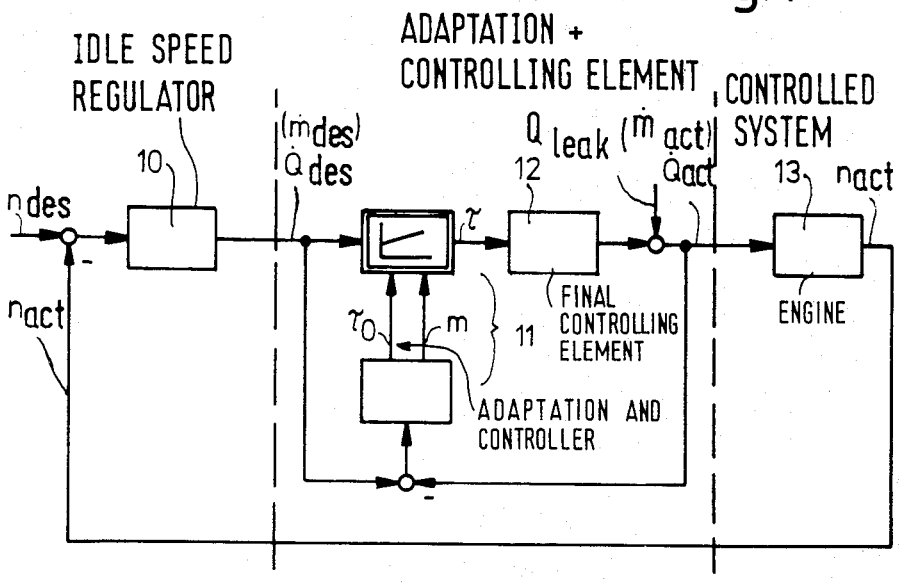
FIG. 1 is a block diagram depicting an idle air charge control arrangement with an idle speed regulator, an idle control element controlled by the regulator, and a characteristic adaptation circuit connected therebetween pursuant to an embodiment of the invention.

Before the invention is described in the following, it is emphasized that the block diagram illustrated in the drawing and showing the invention with reference to discrete components does not limit the invention but serves particularly to illustrate the basic functional effects of the invention and to indicate a possible form of implementation for specific functional sequences. It is to be understood that the individual components and blocks may incorporate analog, digital or also hybrid technology or may comprise, wholly or in part, suitable sections of program-controlled digital systems, for example, microprocessors, microcomputers, digital or analog logic circuits and the like. Accordingly, the following description of a preferred embodiment of the invention is to be valued with regard to the overall functional and time sequences, the effect accomplished by the blocks described and the interaction of the subfunctions illustrated by the individual components, with the references to the individual circuit blocks being merely made for a better understanding.

The following description is directed to an embodiment of the invention wherein the idle air charge control arrangement for an internal combustion engine (spark ignition engine), is optimized so that the desired air quantity value $\dot{Q}_{des}$ provided by an idle speed regulator is converted into an actual quantity $\dot{Q}_{act}$ via an adaptation of a control element characteristic and the idle control element, where $\dot{Q}_{des} \cong \dot{Q}_{act}$.

According to a basic idea of the invention, the adaptation to the instantaneous characteristic of the idle control element and to the leakage air proceeds according to a specific strategy whose objective it is to act additively and/or multiplicatively on the desired quantity delivered by the idle speed regulator. In this manner, the otherwise necessary and customary initial adjustment of the leakage air by means of an additional bypass is eliminated (also over the lifetime).

Referring now to FIG. 1, reference numeral 10 identifies an idle speed regulator, and reference numeral 12 identifies a final controlling element in the form of an idle speed control element which is controlled by the regulator 10 via the apparatus 11 for characteristic adaptation. In this embodiment, the idle speed control element 12 acts on the cross-sectional opening in the intake conduit of an internal combustion engine 13, particularly, by causing a suitable increase or reduction in the cross-sectional area of a bypass valve or also by a motor-driven displacement of the throttle valve.

In this arrangement, the air which the internal combustion engine 13 ultimately receives is composed of the air which the control element 12 allows to pass on the basis of the signals it receives, and a remainder of leakage air flowing, for example, through the throttle valve. As a result of the characteristic adaptation of the invention which takes place in block 11, the air quantity $\dot{Q}_{des}$ or desired air mass value $\dot{m}_{des}$ provided by the idle speed regulator 10 is converted into an electrical actuating quantity $\tau$ in such a manner that the idle speed control element 12 adjusts the air quantity (or air mass) to a value which, together with the leakage air, yields the desired intake air quantity $\dot{Q}_{act}$ (or air mass $\dot{m}_{act}$). The adaptation is performed slowly after operating conditions have been checked. In the speed control circuit of FIG. 1, block 11 (adaptation and controller) is a proportional member with an amplification of unity and thus has no effect on the stability. The control unit simulates the inverse controller characteristic $\tau = \tau_0 + m \cdot Q$ shown in FIG. 3.

In order to perform the characteristic adaptation, two integrators are provided, that is I1 for the characteristic offset (foot point displacement of the characteristic) and I2 for the characteristic slope; these integrators operate only if, as a result of specific operating conditions, the intervention effected thereby on the characteristic adaptation can be released. Therefore, the integrators are connected to release members, with offset integrator I1 being assigned release member FG1 and slope integrator I2 being assigned release member FG2.

Accordingly, slope integrator I2 acts on the desired quantity issued by idle speed regulator 10 multiplicatively via a multiplier M using a predetermined factor;

whereas, the offset correction from the output of integrator I1 is performed additively at a summing point S1.

Both integrators I1 and I2 receive an air quantity differential signal $\Delta\dot{Q}$ from a second summing point or reference point S2. The signal $\Delta\dot{Q}$ corresponds to the deviation of the desired quantity (desired air quantity value $\dot{Q}_{des}$ or desired air mass value $\dot{m}_{des}$) from the actual quantity (air quantity $\dot{Q}_{act}$ or air mass $\dot{m}_{act}$). Actual air quantity $\dot{Q}_{act}$ may be derived from an air flow sensor provided in the intake conduit or it may be obtained in some other manner known per se.

Therefore, the desired relationship $\dot{Q}_{act}=\dot{Q}_{des}$ (it is understood that reference can also be made to the air mass and will no longer be referred to in the following) can be obtained by changing two parameters, that is, by varying the offset K1 and the slope K2. In order to ensure specific initial values of the characteristic, the outputs of integrators I1 and I2 are connected to summing points S3 and S4, respectively, which receive initial values K10 and K20 for the offset and the slope, respectively.

It is essential that the adaptation applied to the instantaneous characteristic of the idle speed control element and the leakage air proceed according to the strategy described below.

Integrator I1 for the offset of the characteristic or the foot point displacement of the characteristic operates only if the throttle valve remains closed for a time exceeding a predetermined time T1=f(n) and if the engine speed n is within a specific range, that is, the idle speed range. Accordingly, release member FG1 for the integrator I1 is configured so that it receives a throttle valve signal DK and the actual value of the engine speed n; and only if the above-mentioned two conditions are satisfied, will the offset integrator I1 be released for operation.

Regarding the action of integrator I2 which causes a variation of the slope of the characteristic by multiplication and thus has a considerably stronger impact on the electrical correcting quantity $\tau$ serving as an input signal for the idle control element, it is to be noted that this integrator will only be released if the throttle valve remains closed for a predetermined time T2 which may be 100 ms, for example. The time relationship for T2 is as follows:

$$T2<t<T1=f(n)$$

by means of which it is possible to eliminate overshoot and corresponding errors introduced by the air flow sensor. Another condition to be met is that $Q_{des}$ is greater than the last value of $Q_{des}$ prior to opening of the throttle valve. This means that the instantaneous adaptation operating point for integrator I2 on the characteristic has to lie above the adaptation operating point reached by the action of offset integrator I1.

Figure 3:
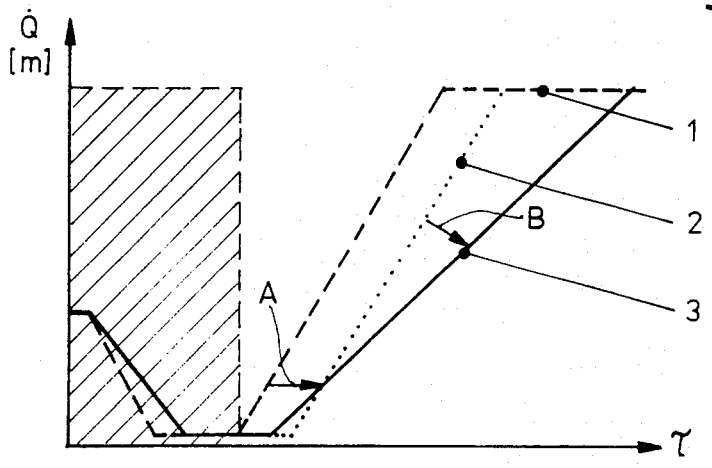

The shape of the controller characteristic $Q=f(\tau)$ of FIG. 3 is dependent on battery voltage, weighting temperature, differential pressure, leakage air and the like. The discontinuous characteristic course in the hatched region in the left part of the drawing plane is merely shown for the sake of completeness for an idle speed controller and, in its capacity as an emergency-operation characteristic, remains unaffected by the measures effected by the invention. Reference numeral 1 identifies the model characteristic in its initial state, numeral 2 the characteristic following offset adaptation, and numeral 3 the characteristic following slope adaptation which is identical with the actual control element characteristic. The first adaptation step is the shift of the operating point by offset as indicated by arrow A. The second step which involves a multiplicative action on the slope (arrow B) may not be performed at an operating point which lies below the offset operating point because this would cause a reverse effect which is undesirable. The slope adaptation always takes place at operating points above the offset operating point.

Accordingly, the conditions on which release block FG2 releases slope integrator I2 are set up such that the slope adaptation takes place only when the air flow rate is greater than, for example, a minimum rate as is the case for the unequivocal idling condition.

To meet these conditions, the preferred procedure is to put the instantaneous values of $\dot{Q}_{des}$ or $\dot{m}_{des}$ in a memory store the moment the throttle valve opens; for this purpose, a memory block SB is provided which receives a throttle valve signal DK and the value $\dot{Q}_{des}$; this storage corresponds to the last operating point at which an adaptation has been performed by the offset integrator I1. To release the slope adaptation, a check is then made to determine if the instantaneous air quantity required ($\dot{Q}_{des}$; $\dot{m}_{des}$) is greater than the value last stored; only if this is the case will a release ensue; the block comparing the two desired values is identified by VG in FIG. 2.

Alternatively, this condition may be replaced by the consideration that a slope adaptation can be released whenever the instantaneous speed is above a specific speed, that is, if for example the condition $n>n_{LL}+500$ $min^{-1}$ is fulfilled, because it can be assumed that a higher engine speed also results in an operating point on the characteristic which lies above the idle point so that the proper characteristic segment is involved. Such an increased speed is the case, for example, after a fully opened throttle or in overrun operation. It is to be noted, however, that this consideration should only apply as an alternative and that the storage of the desired values prior to throttle opening has absolute preference.

Another circumstance has to be mentioned. Multiplier M is preceded by another summing point S4 at which an air quantity $\dot{Q}_0$ is subtracted from desired quantity $\dot{Q}_{des}$. This arrangement serves to optimize the operating range. The value of $\dot{Q}_0$ should not exceed the minimum desired air quantity value $\dot{Q}_{des}$ occurring so that the quantity arriving after summing point S4 at the input of multiplier M is preferably always greater than zero. Adding such a negative value of $\dot{Q}_0$ permits the rotation point of the curve or characteristic to be as close to the operating point as possible. Assuming an ideal case which is, however, undesirable and in which the $\dot{Q}_0$ value supplied coincides exactly with the operating point, it is possible to adapt and represent the curve using but one iteration step, that is, one offset adjustment and one slope adjustment. However, even if the rotation point lies lower as a result of the deviation of the value of $\dot{Q}_0$ from the direct operating point, the total number of iteration steps required is still smaller.

It is an objective of the invention to improve the adaptation of the shape of the characteristic of a final controlling element to the effect that the iteration steps can be reduced and thereby the adaptation process accelerated and also adaptation errors avoided by preventing, for example, several successive slope adaptations without an offset adaptation occurring in the meantime. However, it is further in accordance with an advantageous embodiment of the invention that the offset integrator 11 operates, that is, is released with the throttle valve closed, when the slope integrator 12 is inactive and off-time $T_2$ has elapsed; that slope integrator 12 operates only if $\dot{Q}_{act} \geqq \dot{Q}_{st} + \Delta\dot{Q}$, where $Q_{st}$ is the value stored when the throttle valve was opened and $\Delta\dot{Q}$ is a predeterminable air quantity; that a new slope adaptation cannot occur until after a successful offset adaptation, that is, $\dot{Q}_{des} = \dot{Q}_{act}$; and, that in a slope adaptation the offset integrator 11 follows up according to a specific computation rule, as a result of which the characteristic rotates about the last operating point $\dot{Q}_{st}$ instead of about $\dot{Q}_0$. In the optimum case (if $T_1$ assumes a very high value), it is thus possible to reduce the number of necessary iteration steps to one step.

Figure 2:
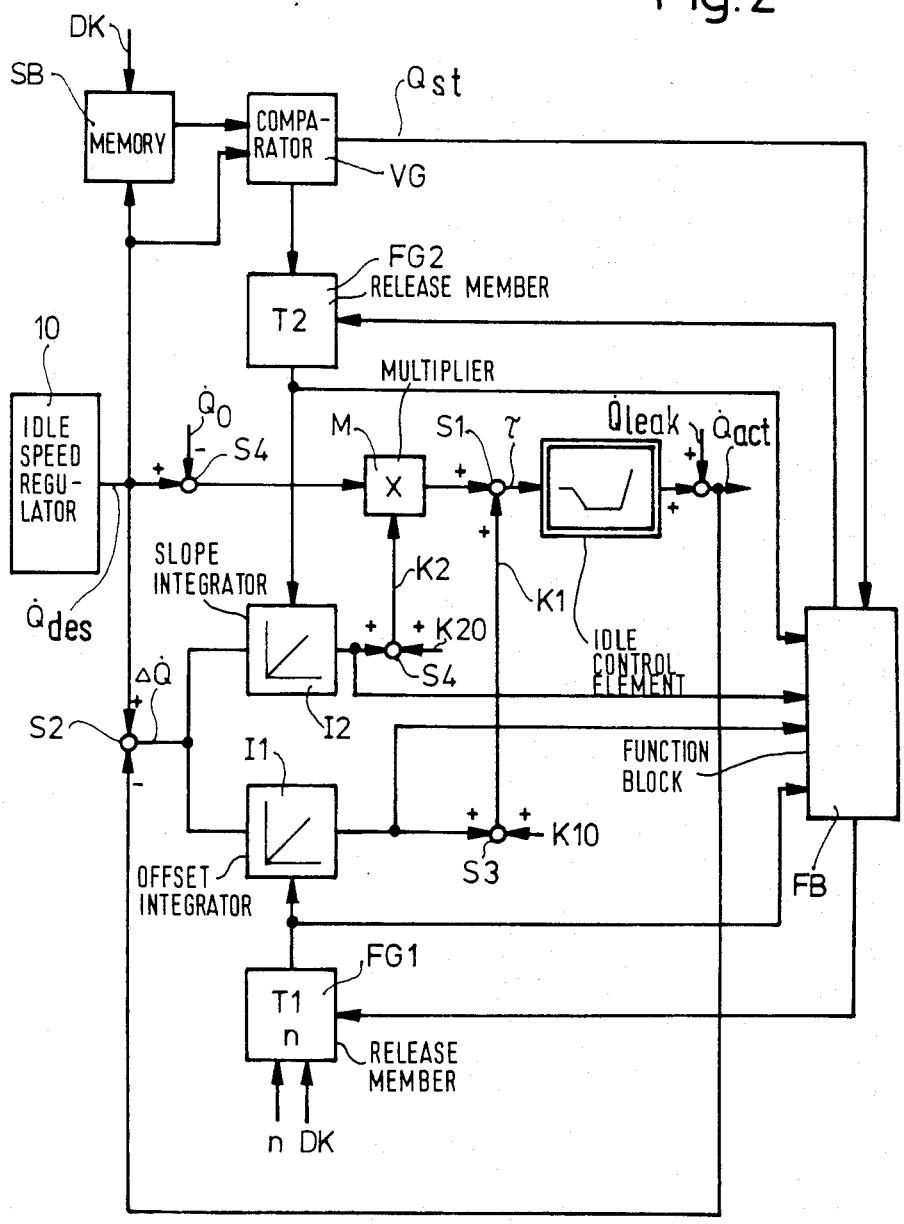
FIG. 2 is a block diagram depicting the apparatus for characteristic adaptation in greater detail; and, FIG. 3 is a diagram of the control element characteristic of air quantity or air mass plotted against the electrical correcting quantity $\tau$, and shows the effects of the adaptation of the invention on the shape of the characteristic.

In order to be able to utilize these arrangements singly and/or preferably wholly in the idle air charge control of the invention, FIG. 2 provides an additional function block FB which is in a position to assume at the same time the integrator interlocking functions and which has applied to its input the signals from the output of the memory block SB (via comparator VG) indicative of the value $\dot{Q}_{st}$ stored when the throttle valve was last opened, as well as the output signals of the two integrators and/or their respective release blocks. In this arrangement, the function block acts with its output signals preferably on the release blocks, thereby ensuring that, in accordance with the above-described arrangements, release member FG1 will release its offset integrator whenever this is in compliance with the above-stated condition, with additional input signals being applied if necessary. It is thereby ensured further that the slope integrator is only released if the actual value of $\dot{Q}_{act}$ is greater than, or at least equal to, the value stored when the throttle valve was opened, plus a predeterminable air quantity, because the slope adaptation results quickly in a relatively strong impact on the correcting output quantity which is only permissible if the specified condition is fulfilled.

Finally, function block FB is configured such as to interlock the releases of offset integrator and slope integrator. This avoids excessive adaptation of the rotation point or foot point of the characteristic by successive slope changes without an offset adaptation occurring in-between. In this connection, it has already been pointed out above that the invention is especially suitable for implementation using arithmetic units, microprocessors, small computers and the like; particularly the arrangements last mentioned represent conditions which, in a suitable program and using a microprocessor or the like, can be well presented and processed easily.

It is understood that the foregoing description is that of the preferred embodiments of the invention and that various changes and modifications may be made thereto without departing from the spirit and scope of the invention as defined in the appended claims.

What is claimed is:

1. Method of adapting a characteristic of a final controlling element to eliminate disturbances and other undesired quantities acting thereon, the method being applicable to apparatus such as an internal combustion engine having an idle air charge control arrangement equipped with an idle control element, the method being especially for adapting the characteristic of said idle control element, the arrangement controlling the quantity of air delivered to the engine during the idle mode of operation and including an idle speed regulator for supplying a desired value $\dot{Q}_{des}$ of air quantity and said idle control element, the method comprising the steps of:

transforming the desired output value ($\dot{Q}_{des}$, $\dot{m}_{des}$) of the idle speed regulator supplied to the idle control element into an adapted electrical control quantity ($\tau$) for said idle control element by means of regulation that takes into account actual value output ($\dot{Q}_{act}$, $\dot{m}_{act}$) which at least partially depends upon the instantaneous actual position of the idle control element; and, said transformation including the step of arithmetically combining said desired output value with the output of at least one of two integrator means influencing the offset and the slope, respectively, of the characteristic of said idle control element;

the integrator means for influencing offset always being released when: the throttle valve is closed; said integrator means for slope adaptation is not released; and, a predetermined blocking period $T_2$ has expired.

2. Method of adapting a characteristic of a final controlling element to eliminate disturbances and other undesired quantities acting thereon, the method being applicable to apparatus such as an internal combustion engine having an idle air charge control arrangement equipped with an idle control element, the method being especially for adapting the characteristic of said idle control element the arrangement controlling the quantity of air delivered to the engine during the idle mode of operation and including an idle speed regulator for supplying a desired value $\dot{Q}_{des}$ of air quantity and said idle control element, the method comprising the steps of:

transforming the desired output value ($\dot{Q}_{des}$, $\dot{m}_{des}$) of the idle speed regulator supplied to the idle control element into an adapted electrical control quantity ($\tau$) for said idle control element by means of regulation that takes into account an actual value output ($\dot{Q}_{act}$, $\dot{m}_{act}$) which at least partially depends upon the instantaneous actual position of the idle control element; and, said transformation including the step of arithmetically combining said desired output value with the output of at least one of two integrators influencing the offset and the slope, respectively, of the characteristic of said idle control element;

the integrator for slope adaptation only being released when the actual value $\dot{Q}_{act}$ is equal to or greater than the last quantity $Q_{st}$ stored when the throttle valve was opened plus a predeterminable quantity $\Delta Q$.

3. Method of adapting a characteristic of a final controlling element to eliminate disturbances and other undesired quantities acting thereon, the method being applicable to apparatus such as an internal combustion engine having an idle air charge control arrangement equipped with an idle control element, the method being especially for adapting the characteristic of said idle control element the arrangement controlling the quantity of air delivered to the engine during the idle mode of operation and including an idle speed regulator for supplying a desired value $\dot{Q}_{des}$ of air quantity and said idle control element, the method comprising the steps of:

transforming the desired output value ($\dot{Q}_{des}$, $\dot{m}_{des}$) of the idle speed regulator supplied to the idle control element into an adapted electrical control quantity ($\tau$) for said idle control element by means of regulation that takes into account an actual value output ($\dot{Q}_{act}$, $\dot{m}_{act}$) which at least partially depends upon the instantaneous actual position of the idle control element; and, said transformation including the step of arithmetically combining said desired output value with the output of at least one of two integrators influencing the offset and the slope, respectively, of the characteristic of said idle control element;

interlocking offset adaptation and slope adaptation taking place in such a manner that, after each slope adaptation, first a successful offset adaptation occurs ($\dot{Q}_{des}=\dot{Q}_{act}$) before a new slope adaptation is released.

4. Method of adapting a characteristic of a final controlling element to eliminate disturbances and other undesired quantities acting thereon, the method being applicable to apparatus such as an internal combustion engine having an idle air charge control arrangement equipped with an idle control element, the method being especially for adapting the characteristic of said idle control element the arrangement controlling the quantity of air delivered to the engine during the idle mode of operation and including an idle speed regulator for supplying a desired value $\dot{Q}_{des}$ of air quantity and said idle control element, the method comprising the steps of:

transforming the desired output value ($\dot{Q}_{des}$, $\dot{m}_{des}$) of the idle speed regulator supplied to the idle control element into an adapted electrical control quantity ($\tau$) for said idle control element by means of regulation that takes into account an actual value output ($\dot{Q}_{act}$, $\dot{m}_{act}$) which at least partially depends upon the instantaneous actual position of the idle control element; and, said transformation including the step of arithmetically combining said desired output value with the output of at least one of two integrators influencing the offset and the slope, respectively, of the characteristic of said idle control element;

for each slope adaptation, the offset integrator following up in such a manner that the characteristic rotates about the last operating point corresponding to the valve $\dot{Q}_{st}$ stored by the last opening of the throttle valve, the rotation being effected by the slope adaptation.

5. Apparatus for adapting a characteristic of a final controlling element to eliminate disturbances and other undesired quantities acting thereon, the apparatus being especially for adapting the idle control element characteristic in the idle air charge control arrangement of an internal combustion engine, the arrangement controlling the quantity of air delivered to the engine during the idle mode of operation and including an idle speed regulator for supplying a desired value $\dot{Q}_{des}$ of air quantity and said arrangement further including said idle control element, the apparatus for adapting the characteristic of the idle control element comprising:

first integrator means for providing a first output for additively influencing said desired value for offset adapting the characteristic of said idle control element;

second integrator means for providing a second output for multiplicatively influencing said desired value for slope adapting the characteristic of said idle control element;

release means for releasing at least one of said integrators for influencing said desired value; and, means for interlocking the releases of said first integrator means and said second integrator means to prevent excessive adaptation by changes of slope without an offset adaptation of the foot point (rotation point) of the characteristic occurring between said slope changes.

6. Apparatus for adapting a characteristic of a final controlling element to eliminate disturbances and other undesired quantities acting thereon, the apparatus being especially for adapting the idle control element characteristic in the idle air charge control arrangement of an internal combustion engine, the arrangement controlling the quantity of air delivered to the engine during the idle mode of operation and including an idle speed regulator for supplying a desired value $\dot{Q}_{des}$ of air quantity and said arrangement further including said idle control element, the apparatus for adapting the characteristic of the idle control element comprising:

transformative means for transforming the desired output value ($\dot{Q}_{des}$, $\dot{m}_{des}$) of the idle speed regulator supplied to the idle control element into an adapted electrical control quantity ($\tau$) for said idle control element by means of regulation that takes into account an actual value output ($\dot{Q}_{act}$, $\dot{m}_{act}$) which at least partially depends upon the instantaneous actual position of the idle control element;

first integrator means for influencing said desired value for offset adapting the characteristic of said idle control element;

second integrator means for influencing the desired value for slope adapting the characteristic of said idle control element;

said transformation means including means for arithmetically combining said desired output value with the output of at least one of said two integrator means; and, release means for always releasing said first integrator means when: the throttle valve of the engine is closed; said second integrator means for slope adaptation is not released; and, a predetermined blocking period $T_2$ has expired.

* * * * *